US005816143A

United States Patent [19]

Wagner et al.

[11] Patent Number: 5,816,143

[45] Date of Patent: Oct. 6, 1998

[54] PROCESS FOR SATINING PAPER AND CALENDER FOR CARRYING OUT THE PROCESS

[75] Inventors: Ulrich Wagner, Wachtendonk-Wankum; Dirk Cramer, Duisburg, both of Germany

[73] Assignee: Voith Sulzer Finishing GmbH, Krefeld, Germany

[21] Appl. No.: 805,778

[22] Filed: Feb. 25, 1997

[30] Foreign Application Priority Data

Feb. 28, 1996 [DE] Germany ..... 196 07 476.2

[51] Int. Cl.[6] ..... D21G 1/02

[52] U.S. Cl. ..... 100/38; 100/99; 100/155 R; 100/162 B; 100/163 A; 100/168; 100/173; 100/327; 100/331; 162/206

[58] Field of Search ..... 100/35, 38, 155 R, 100/161–168, 173, 47, 99, 327, 331, 334, 103; 72/247; 162/206, 207

[56] References Cited

FOREIGN PATENT DOCUMENTS 1046470 12/1958 Germany .

3907216 9/1989 Germany .

4121381 6/1992 Germany .

*Primary Examiner*—Stephen F. Gerrity

*Attorney, Agent, or Firm*—Greenblum & Bernstein, P.L.C.

[57] ABSTRACT

A process and device for satining paper may include guiding a sheet through a roll gap defined by a heated hard roll and a soft roll having with a covering. A paper sheet width of the paper may be less than a width of a cylindrical part of each of the covering and the hard roll. The two rolls may be axially adjusted in relation to each other and in accordance with the paper sheet width. Further, the two rolls are positioned such that a first sheet edge is located adjacent a first end of the cylindrical part of the covering and a second sheet edge is located adjacent a second end of the cylindrical part of the hard roll. That is, the cylindrical parts of the covering and hard roll are positioned to be directly over each other, i.e., beyond the sheet edge, at most by a predetermined permissible edge width.

24 Claims, 3 Drawing Sheets

PROCESS FOR SATINING PAPER AND CALENDER FOR CARRYING OUT THE PROCESS

CROSS-REFERENCE OF RELATED APPLICATION

The present invention claims the priority under 35 U.S.C. § 119 of German Patent Application No. 196 07 476.2 filed on Feb. 28, 1996, the disclosure of which is expressly incorporated by reference herein in its entirety.

BACKGROUND OF THE INVENTION

1. Field of the Invention

The present invention relates to a process for satining paper that may be guided as a sheet through at least one roll gap formed by a hard roll that may be heated and a soft roll that may include, e.g., an elastic covering. The present invention may also include a calender for carrying out the above-noted process, that includes at least one roll gap formed between a heatable hard roll and a soft roll having a predetermined covering, e.g., elastic. The hard and soft rolls may be axially adjustable with respect to each other to eliminate contact between the surface of the soft roll and the heated surface of the hard roll.

2. Discussion of Background Information

In the current state of the art, calenders, which include a hard roll and a soft roll forming a gap, utilize high temperatures on the surface of the hard roll. However, because the temperature stability of an elastic covering of a soft roll is often limited to values below that of the surface of the heated hard roll, the calender must avoid overheating of the elastic covering. The potential overheating may be avoided in the locations in which the elastic covering is covered by a heat-dissipating paper sheet. However, sections of the elastic covering located outside the dimensional bounds of the paper sheet potentially risk overheating. Further, the absolute temperature is not the only detriment encountered by the calender. That is, the calenders may be damaged if a predetermined temperature difference is exceeded between a section of the elastic covering covered by the sheet and a section of the elastic covering that is not covered by the sheet.

To avoid damaging the calender, DE 39 07 216 A1 discloses guiding the sheet through the roll gap in which the sheet width is at least as great as the width of the covering. However, this process results in a sheet having a non-calendered edge strip which must be cut off and removed. Further, in calenders with several roll gaps, the non-satined edges potentially lead to sheet travel problems. This process is also not practicable if sheets of different widths must be produced.

Another process disclosed in DE 41 21 381 C1 suggests maintaining a sheet width that is smaller than the soft roll and cooling the uncovered part of the elastic covering by applying a thin and sharply delimited water film. A cooling device is moved along a guide parallel to the roll and, thus, is adaptable for different sheet widths. However, the cooling devices and temperature measurement systems required for process are expensive, unreliable, and not effective enough at high surface temperatures.

SUMMARY OF THE INVENTION

An object of the present invention, therefore, is to provide effective protection for the elastic covering of the soft roll from overheating regardless of the sheet width. Further, the present invention may carry out the above object with insufficient cooling or even without cooling.

The present invention includes selecting a sheet width that may be smaller than a width of a cylindrical part of both the elastic covering of the soft roll and the hard roll. The two rolls may be axially adjustable in relation to each other and move in accordance with the sheet width. That is, a first sheet edge may be maintained adjacent the cylindrical part of the elastic covering and a second sheet edge may be maintained adjacent the cylindrical part of the hard roll. It is contemplated that each cylindrical part may protrude beyond the sheet edge by no more than a predetermined permissible edge width.

In the process of the present invention, the thickness of the paper sheet maintains separation of the cylindrical parts of the hard roll and the elastic covering over not only the entire width of the paper sheet, but also over a small region located adjacent and outside the edges of the paper sheet. In the separation regions between the cylindrical parts, the present invention eliminates the impermissible heating of the edges of the elastic covering. Accordingly, there is a permissible edge width along the protruding edge of the elastic covering, i.e., not covered by the paper sheet, which is related to the operational conditions and the elastic material. Preferably, the protruding region is approximately 10 to 15 mm. However, because the permissible edge region cannot be maintained if paper sheets of different widths are to be satined, the present invention utilizes hard and soft rolls, forming a roll gap, that may be axially adjustable in relation to each other. This ensures that a first sheet edge may be selectively positioned adjacent to an end of the cylindrical part of the elastic covering and a second sheet edge may be selectively positioned adjacent to an end of the cylindrical part of the hard roll. Therefore, in accordance with the present invention, the elastic covering may by located opposite the heated portion of the hard roll surface only over a predetermined permissible edge region.

In a particular embodiment of the present invention, the first sheet edge may be located in a fixed position that is independent of the sheet width. Thus, the features of the present invention may be practiced with only one roll being axially adjustable with the respect to the other calender rolls. Since the remaining calender rolls may be axially fixed, this embodiment provides a particularly simple construction.

To maintain proper location of the axially adjustable roll with respect to the sheet edge, the sheet edge may be scanned to detect the sheet width. In accordance with the scanned sheet width data, one of the rolls may be axially adjusted to maintain the predetermined permissible edge. Accordingly, the present invention enables automatic maintenance of the predetermined permissible edge region when the sheet width changes or fluctuates.

In an alternative embodiment, the paper sheet may be supplied centrally and both rolls may be axially adjusted in opposite directions to maintain the predetermined permissible edge region.

In the above embodiment in which the paper is supplied centrally, the present invention may scan at least one sheet edge to detect the sheet width and the two rolls may be adjusted in accordance with the detected sheet width. This also enables automatic maintenance of the predetermined permissible edge region when the sheet width changes or fluctuates.

According to the present invention, the soft roll may include a zone-controlled deflection adjustment roll in which pressure in the zones located outside of the sheet width may be reduced in comparison to zones within the sheet width. The deflection adjustment roll may enable a desired compression strain profile to be set. Accordingly, the axial adjustment of the rolls may be performed in accordance with pressure readings or measurements.

A calender for carrying out the process of the present invention, may include two rolls that may be axially adjustable or positionable with respect to each other, and one of the rolls may be located in accordance with a location of a first sheet edge and the other roll may be located in accordance with a location of a second sheet edge. The calender may also include a device for axially adjusting or displacing the two rolls such that an elastic covering of the one roll, i.e., the soft roll, may be positioned directly opposite the heated surface of the other roll, i.e., the hard roll, over a region including the sheet width and the permissible edge width.

In a particular embodiment of the present invention, a sheet guidance device may be provided to hold the first sheet edge in a fixed desired position, a detection device may be provided to detect a position of the second sheet edge, and only one of the two rolls needs to be necessarily axially adjustable. The position of the axially adjustable roller may be established in accordance with an output of the detection device. Because the elastic covering of the soft roll may be protected from excessive heat through adjustment of only a single roll, the device may be structurally simplified by only supporting one roll for axial movement.

Further to the single axially adjustable roll discussed above, in another particular embodiment of the present invention, the hard roll may be designated as the axially adjustable roll. Consequently, the soft roll may be axially fixed with respect to the paper sheet and may maintain a fixed location with respect to the first sheet edge.

In another embodiment of the present invention, the hard roll may form two roll gaps by abutting two soft rolls. Accordingly, the hard roll may be utilized to heat two separate roll gaps. However, the present invention may sufficiently adapt to the paper width while only axially adjusting one roll.

In another embodiment, the present invention may include a sheet guidance device that supplies the sheet centrally, a detection device that detects a position of a first sheet edge, and that both rolls may be be axially adjusted with respect to each other in amounts determined in accordance with the detection device. This particular embodiment may have a large number of potential uses. Further, the rolls may be axially adjusted in identical amounts or in different amounts. For example, in in-line satining processes, the sheet may not be precisely centrally supplied to the calender, i.e., the paper may be somewhat off-center. However, in accordance with this embodiment, each of the rolls may be axially adjusted. It also occurs that the sheet is not supplied precisely in the center, but is supplied outside the center. In this case, the rolls may be adjusted in correspondingly different amounts to compensate for the off-centering of the sheet.

Structurally, the present invention may advantageously secure the axially adjustable roll in a bearing block, and may further include an adjusting drive mechanism along a guide on a carrying element that carries and actuation device for the drive mechanism. According to the present invention, the additional expenditure for the feature of axial adjustability is low. The adjusting drive mechanism can have, for example, an adjusting spindle or a piston motor. The roll pin can be moved in the bearing block, with or without bearings.

In particular, the carrier element may be coupled to a calender column via a pivoting lever.

The present invention may be practiced with all materials utilized as an elastic covering. Further, the present invention is particularly suited for elastic covering comprised of a fiber reinforced plastic having a high temperature stability. The temperature stability, i.e., relative to the roll displacement, may permit the surface temperature of the hard roll to be maintained at a high level, e.g., 130° to 200° C., because the plastic may still withstand the radiated heat in the uncovered region.

Further, a take-off device may be provided for the sheet having a winding that may be axially adjusted in relation to the rolls. Thus, a take-off device required for off-line operation may an be additionally utilized to determine the position of the first sheet edge with respect to the axially adjustable rolls.

The calender, according to the present invention, may be particularly suitable in a paper making machine. Further, the present invention may be readily utilized in an in-line operation, even if the produced paper sheet includes sections having different widths.

The present invention may be directed to a process for satining paper in a calender. The calender may include at least one roll gap formed between a heatable hard roll and a soft roll having an elastic covering, the hard roll and the soft roll may each include a cylinder portion having substantially similar widths, and the paper to be satined may have a width less than the width of the cylinder portions.

The process may include guiding the paper through the at least one roll gap; axially adjusting the hard roll relative to the soft roll, in accordance with the width of the paper, to position a first end of the soft roll to protrude beyond a first edge of the paper within a predefined edge width and to position a first end of the hard roll to protrude beyond a second edge of the paper within a predefined edge width.

In accordance with another feature of the present invention, the process may also include fixing a position of one of the first edge and the second edge independent of the sheet width and axially adjusting only one of the hard roll and soft roll.

In accordance with a further feature of the present invention, the process may also include scanning an other of the one edge to determine the sheet width and axially adjusting the one roll in accordance with the determined sheet width.

In accordance with still another feature of the present invention, the process may also include supplying the paper symmetrically with respect to a center of the calender and axially adjusting each roll in opposite directions.

In accordance with yet another feature of the present invention, the process may also include scanning at least one of the first and second edge, determine the sheet width, and axially adjusting each roll in accordance with the determined sheet width.

In accordance with a still further feature of the present invention, the soft roll may include a zone-controlled deflection adjustment roll having a plurality of pressure zones in which the pressure zones located beyond the region covered by the width of the sheet are reduced with respect to the pressure zones within the region covered by the width of the sheet.

The present invention may also be directed to a calender for satining paper. The calender may include a heated hard roll, a soft roll having a covering, at least one roll gap formed between the hard roll and the soft roll, and a device for axially adjusting the rolls relative to each other. A first end of the hard roll may be positioned with respect to a first edge of the paper and a first end of the soft roll may be positioned with respect to a second edge of the paper.

In accordance with another feature of the present invention, the calender may also include a sheet guidance device that holds one of the first and second edge in a fixed position, a detection device that detects a position of an other of the one edge, and the axially adjusting device may adjust only one of the rolls with respect to an output of the detection device. According to a further feature, the only one roll adjusted is the hard roll. Alternatively, the calender may also include an additional soft roll such that the hard roll, the soft roll and the additional soft roll may form two roll gaps.

In accordance with a further feature of the present invention, the calender may also include a sheet guidance device that supplies the sheet centrally with respect to the calender, a detection device that detects the position of at least one sheet edge, and a device for axially adjusting each roll with respect to the paper and in accordance with an output of the detection device.

In accordance with a still further feature of the present invention, the calender may also include a guide, a carrier element, an adjustment drive mechanism, a bearing block being movable along the carrier element, via the guide, by the adjustment drive mechanism, an actuation device for the adjustment drive mechanism coupled to the carrier element, and the axially adjustable roll being secured in the bearing block.

In accordance with still another feature of the present invention, the calender may include a calender column and a pivoting lever such that the calender column may be coupled to the carrier element through the pivoting lever.

In accordance with a further feature of the present invention, the covering may include of a fiber reinforced plastic that has a high temperature stability.

In accordance with yet another feature of the present invention, the calender may include a take-off device and a winding for supplying the paper such that the take-off device may be axially adjustable with respect to the rolls.

In accordance with another feature of the present invention, the calender may be part of a paper making machine.

The present invention may also be directed to a process for satining paper in a calender in which the calender may include a hard roll and a soft roll, a roll gap formed between the hard roll and soft roll, and the hard roll and the soft roll may each include a cylinder having a substantially similar width. The process may include guiding paper to be satined through the roll gap, the paper having a width less than the substantially similar width of the hard and soft rolls, and axially adjusting the hard roll with respect to the soft roll such that a thickness of the paper separates a heated surface of the hard roll from a surface of an elastic covering of the soft roll.

In accordance with another feature of the present invention, the axial adjustment may include positioning a first end of the hard roll proximately adjacent a first edge of the paper, positioning a first end of the soft roll proximately adjacent a second edge of the paper, forming a gap between the first end of the hard roll and the surface of the elastic covering of the soft roll located opposite the first end of the soft roll, and forming a gap between the first end of the soft roll and the heated surface of the hard roll located opposite the first end of the hard roll.

In accordance with still another feature of the present invention, the axial adjustment may also include forming a gap between the first edge and the first end of the hard roll having a width less than or equal to a predetermined width and forming a gap between the second edge and the first end of the soft roll having a width less than or equal to a predetermined width.

In accordance with a further feature of the present invention, the process may also include arranging one of the first and second edges in a fixed position, determining a width of the paper, and axially adjusting the hard rolls in accordance with the detected width of the paper. Further, the process may include detecting a location of an other of the one edge with a detection device, determining a width of the paper in accordance with the detected location of the other edge, forwarding the determined width to an adjustment drive mechanism, and driving a bearing block securing the hard roll to a position in accordance with the determined width.

In accordance with a further feature of the present invention, the process may also include supplying the paper substantially symmetrically with respect to a center of the calender, determining a width of the paper, and axially adjusting each of the rolls in accordance with the detected width of the paper.

In accordance with still another feature of the present invention, the process may include detecting a location of one of the edges of the paper with a detection device, determining a width of the paper in accordance with the detected location of the one edge, forwarding the determined width to an adjustment drive mechanism, and driving a bearing block securing the hard roll to a position in accordance with the determined width.

In accordance with yet another feature of the present invention, the process may further include detecting a location of each edge of the paper with a detection device, determining a width of the paper in accordance with the detected location of the edges, forwarding the determined width to an adjustment drive mechanism, and driving a bearing block securing the hard roll to a position in accordance with the determined width.

Further embodiments and advantages can be seen from the detailed description of the present invention and the accompanying figures.

BRIEF DESCRIPTION OF THE DRAWINGS

The present invention is further described in the detailed description which follows, in reference to the noted drawing by way of non-limiting examples of preferred embodiments of the present invention, wherein same reference numerals represent similar parts throughout the several views of the drawings, and wherein.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 1:
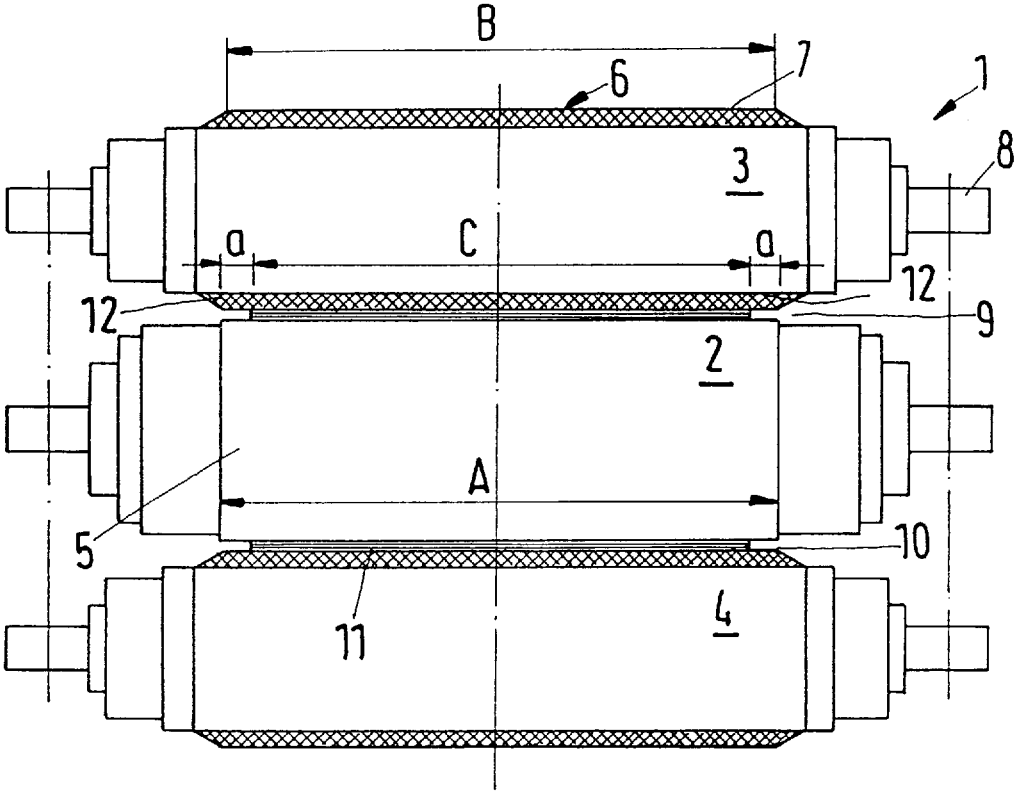
FIG. 1 illustrates a three-roll calender device processing a paper sheet having a maximal width.
Figure 2:
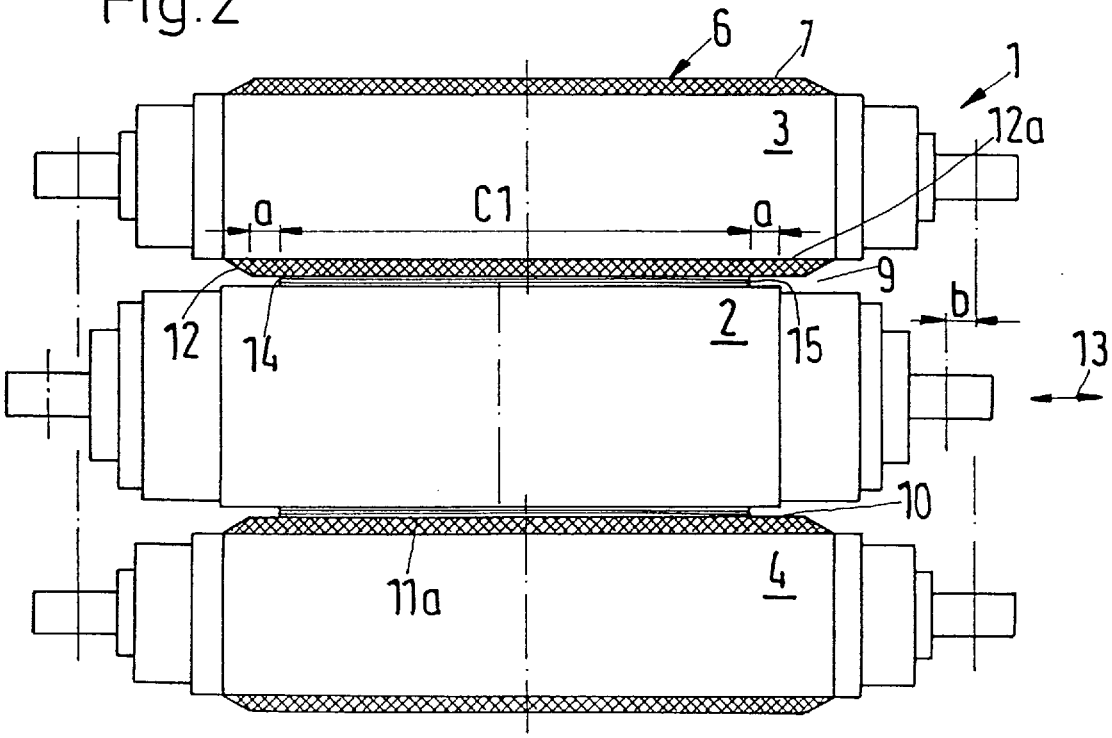
FIG. 2 illustrates the three-roll calender of FIG. 1 processing a paper sheet having a width less than maximal.
Figure 3:
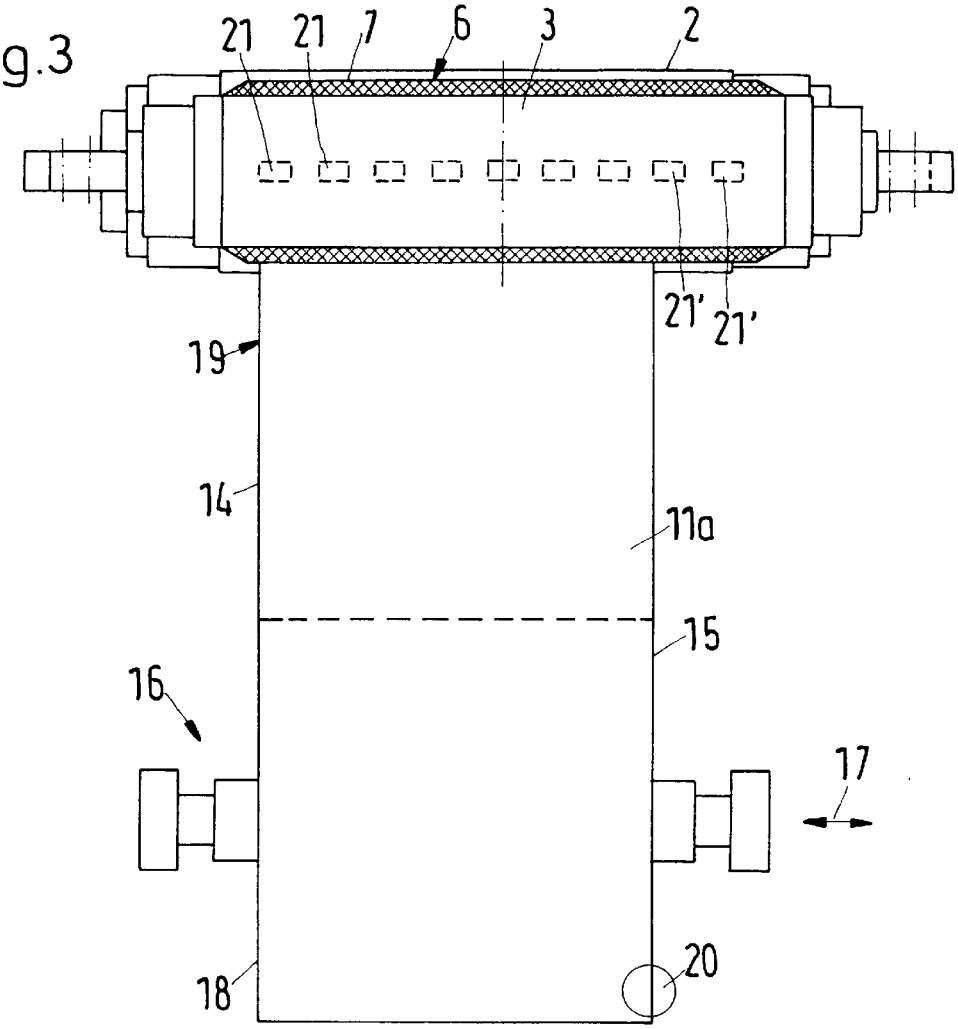
FIG. 3 illustrates a top view of the three-roll calender of FIG. 2 further including take-off device.

A three-roll calender 1 illustrated in FIGS. 1–3 may include a hard roll 2 and two soft rolls 3 and 4. Soft rolls 3 and 4 may be disposed on opposite sides of hard roll 2. Hard roll 2 may include a cylindrical part 5 that extends for a width A, and may be heated in an approximately even manner, e.g., by heating oil, conducted near the surface of the roll via bores positioned parallel to the axis, by an electrical heating device or the like. Soft rolls 3 and 4 may include an elastic covering 6 having a cylindrical portion 7 with a width B. In accordance with a preferred embodiment, widths A and B are substantially the same width. Elastic covering 6 may be comprised of, e.g., a fiber reinforced plastic having a high temperature stability, e.g., up to 130° C. Thus, utilizing this particular elastic material enables the heated surface of the hard roll to be maintained at a high level, e.g., 130° to 200° C.

Rolls 2, 3, and 4 may be retained in bearings (not shown) via roll pins 8. Calender 1 may also include roll gaps 9 and 10 formed between rolls 2 and 3 and rolls 3 and 4, respectively. The paper sheet 11 supplied to the calender may be guided through each of the roll gaps 9 and 10 to provide the satin finish on the paper sheet 11. Roll gaps 9 and 10 provide the desired finish via pressure exerted by soft rolls 3 and 4 against hard roll 2 and through the heat in hard roll 2 being transmitted to the paper sheet 11. Paper sheet 11 may have a predetermined maximal width C that may be somewhat smaller than both width A of cylindrical portion 5 the hard roll 2 and width B of cylindrical portion 7 of elastic covering 6. As noted above, widths A and B may be substantially equal to each other. On each side of paper sheet 11, a region 12 may be formed along cylindrical portion 7 of elastic covering 6 between the paper sheet's edge and an outer extent (width-wise) of elastic covering 6. As shown, a predetermined permissible edge width a, e.g, 10 to 15 mm, may be formed adjacent and outside of the paper sheet edges. As shown in FIG. 1, regions 12 are not covered by paper sheet 11, but, rather, maintain a separation between cylindrical portion 5 and elastic covering 6 to eliminate the potential for overheating and for inadvertently damaging elastic covering 6.

In FIG. 2, calender 1 may be utilized to satin a paper sheet 11*a* having with a width C1, which is narrower than the maximal width C depicted in FIG. 1. Hard roll 2 may be mounted for axial movement in either direction indicated by arrow 13. As shown, hard roll 2 may be axially adjusted or displaced to the left by an amount b to compensate for the narrower paper sheet. As in FIG. 1, a predetermined permissible edge region a may be formed adjacent to a first edge 14 of paper sheet 11*a*. Further, the axial adjustment of hard roll 2 may form a predetermined permissible edge region a adjacent a second edge 15 of paper sheet 11*a*. While a significantly larger portion of elastic covering 6 overlaps the second edge 15, only a portion equal to predetermined permissible edge region a lies directly over the heated surface of hard roll 2. Because the portion of elastic covering 5 lying directly over the heated surface of hard roll 2 and the heated surface itself are maintained in a spaced apart manner, elastic covering 6 does not directly contact the heated surface, thus, potential overheating of the elastic covering 6 is eliminated.

FIG. 3 shows a top view of calender 1 depicted in FIG. 2. FIG. 3 also includes an arrangement based upon an off-line operation. For example, sheet 11*a* may be supplied to calender 1 from a take-off device 16 having a winding 18 that may be inserted onto a core. The core may be be axially adjustable back and forth as shown by arrow 17. Thus, takeoff device 16 may be adjusted so that first sheet edge 14 (i.e., the left edge) assumes a desired position 19, e.g., to form a permissible edge region a of a predetermined width. This edge may be fixed or constant such that any variation in the paper sheet width does not effect the location of the first edge with respect to the formed permissible edge region a, shown in FIG. 2.

Second sheet edge 15 may be detected by a detection device 20. The axial adjustment of hard roll 2 may be made in accordance with the location of the second edge 15 detected by detection device 20. Thus, as shown in FIG. 2, as the paper sheet width narrows, detection device 20 detects the narrowing width and provides a signal to shift hard roll 2, e.g., to the left, to properly maintain the predetermined permissible edge region a adjacent the second edge 15.

As is more clearly indicated in FIG. 3, elastic roll 6 may be a deflection adjustment roll in which a jacket may be loaded in individual zones 21 in such a way that a desired compressive strain profile may be set or established at roll gap 9. Each zone 21 may correspond, e.g., to a hydrostatic support element, and each zone 21', i.e., the zones located outside the width of sheet 11*a*, may be acted upon with a lower pressure than zones 21.

Figure 4:
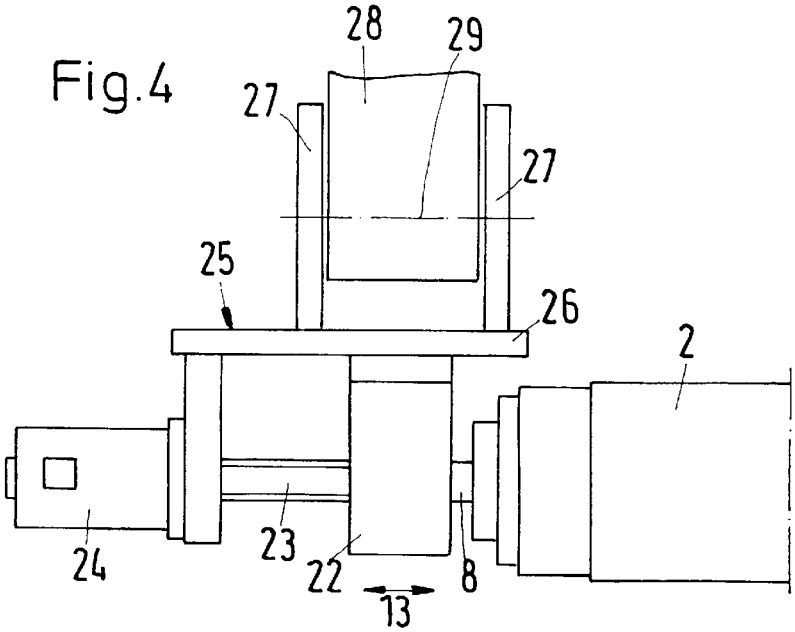
FIG. 4 illustrates an exemplary axial adjustment device.

According to FIG. 4, hard roll 2 may be supported by roll pin 8 in a bearing block 22. Bearing block 22 may be axially adjusted in the directions indicated by arrow 13 through a spindle 23. Spindle 23 may be be manually or automatically rotated by an actuation device 24, e.g. a motor. A carrier element 25 may include an axial guide 26 for bearing block 22 and may carry actuation device 24. Carrier element 25 may be fastened to levers 27 which are secured to a calender column 28 for pivotable movement around an axis 29. For example, actuation device 24 may axially adjust the position of hard roll 2 depending on a reading by detection device 20.

Figure 5:
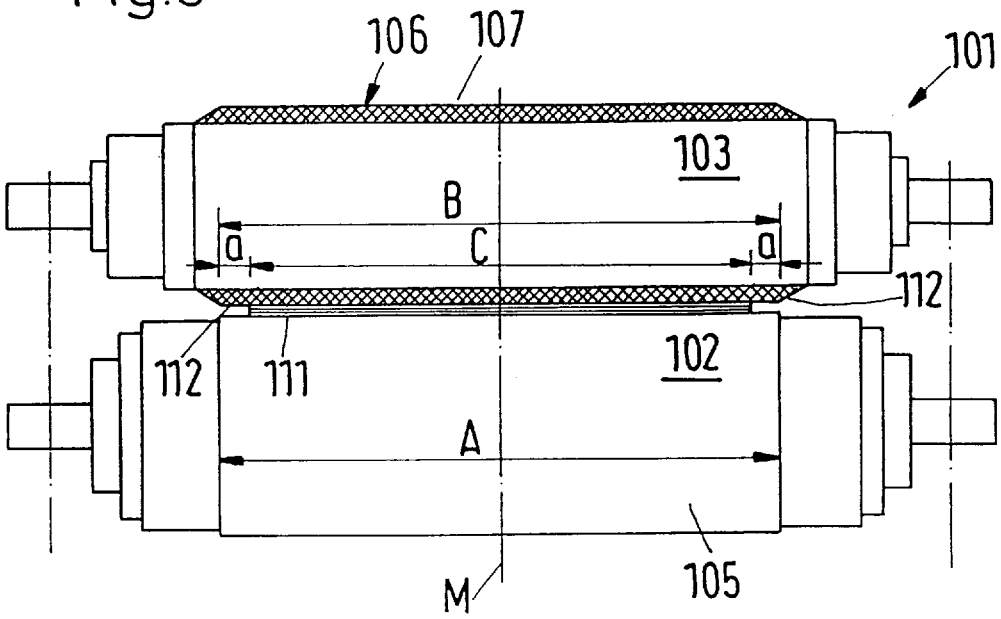
FIG. 5 illustrates a two-roll calender processing a paper sheet having a maximal width.
Figure 6:
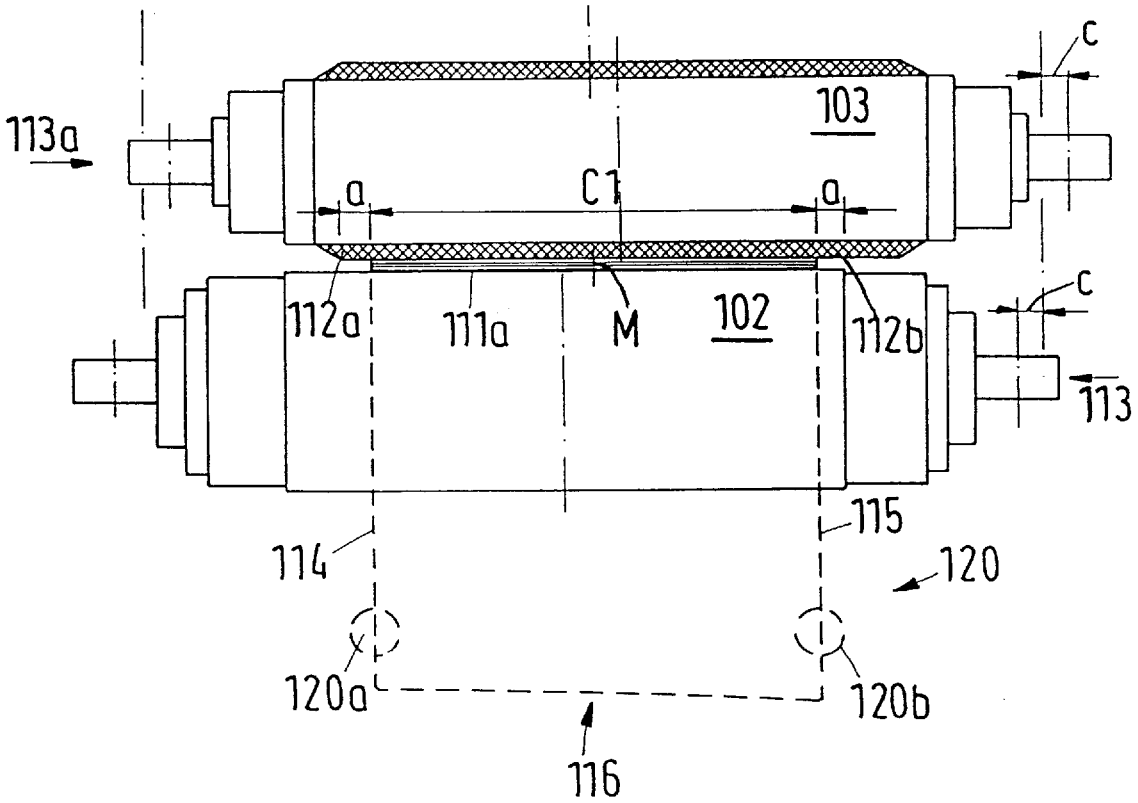
FIG. 6 illustrates the two-roll calender FIG. 5 processing a paper sheet having a width less than maximal.

In an alternative embodiment of the present invention, FIGS. 5 and 6 illustrate a two-roll calender 101 which may be similar in design to the three-roll calender of FIGS. 1–3. Calender 101 may include a hard roll 102 and a soft roll 103 having an elastic covering 106. Elastic covering 106 may include a cylindrical portion 107, which extends beyond each edge of paper sheet 111 to form a region 112. The width of region 112 may, e.g., correspond to or be less than the predetermined permissible edge width. Width A of cylindrical portion 105, width B of cylindrical portion 107, and maximal width C of paper sheet 111 may correspond to the similar features depicted in FIG. 1.

In FIG. 6, a narrower paper sheet 11*a*, e.g., having a sheet width C1, may be positioned to be satined through the roll gap formed between the rolls of calender 101. Paper sheet 11*a* may be supplied to calender 101, e.g., symmetrically with respect to a center line M. In an in-line operation, a preceding part of a paper making machine may be used as a sheet guidance device 116. Because the paper sheet is supplied symmetrically with respect to center line M, any variation of sheet width or any variance in the center line M may affect first edge 114, second edge 115, or both edges of paper sheet 111*a*. Thus, to properly maintain edge regions 112*a* and 112*b* having a width of less than or equal to predetermined permissible edge region a and to properly maintain separation of the heated surface of hard roll 102 and elastic covering 106, hard roll 102 may be shifted, e.g., to the left, i.e., in a direction of arrow 113, by an amount necessary to provide edge region 112*a* of the proper dimension, e.g. distance c, and soft roll 103 may be shifted, e.g., in an opposite direction with respect to the movement of hard roll 102, i.e., in a direction of arrow 113*a*, by an amount necessary to provide edge region 112*b* of a proper dimension, e.g., a same distance c. Clearly, when the paper sheet is properly supplied along center line M, variation in width will equally effect each side edge, thus, the axial adjustment distance for each roll will be the same.

A detection device 120 may include two detection points 120*a* and 120*b* to detect a position of first sheet edge 114 and/or a position of second sheet edge 115. As noted above, adjustment path c of soft roll 103 in the direction of arrow 113*a* depends upon the detected position of first sheet edge 114, and adjustment path c of hard roll 102 in the direction of arrow 113 depends upon the detected position of second sheet edge 115. In many instances, only single detection point located adjacent a single sheet edge may be sufficient to properly adjust the rolls. This is particularly true if it can be ensured that the paper sheet will always runs in the center, i.e., symmetrical to center line M, e.g., as with in-line calenders. If the center line of the paper sheet is susceptible to variation from center line M, then it is preferred that detection points 120*a* and 120*b* be utilized to detect each sheet edge 114 and 115 of paper sheet 111*a*. This enables the system to compensate for width variations as well as variations from center line M. In these cases, the axial adjustment distance for hard roll 102 may not be similar to the adjustment distance of soft roll 103.

If it can be ensured that fluctuations in sheet width C will be slight, the detection device does not have to carry out constant monitoring of the sheet edge. Rather, in accordance with an alternative embodiment of the present invention, it may be sufficient to detect the position of one or both sheet edges with the detection device, to correspondingly axially adjust the calender rolls, and to permit adjustment during subsequent operation of the calender. In the embodiment in FIGS. 1 to 3, for example, a procedure may be followed such that the width of the paper sheet winding may be measured and the paper sheet winding may be axially shifted until the first sheet edge has reached its desired position.

While the exemplary embodiments discussed herein related to two-roll and three-roll calenders which may be operated in the form of so-called soft calenders, calenders comprising more than three rolls are also contemplated by the present invention. In particular, the present invention may be utilized with super calenders which may include a stack of rolls which are loaded from one end. With super calenders, the rolls may be axially shifted by different distances so as to compensate for the increasing width of the sheet from roll gap to roll gap.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A process for satining paper in a calender, the calender including at least one roll gap formed between a heatable hard roll and a soft roll having an elastic covering, the hard roll and the soft roll each including a cylinder portion having substantially similar widths, and the paper to be satined having a width less than the width of the cylinder portions, said process comprising:

guiding the paper through the at least one roll gap;

axially adjusting the hard roll relative to the soft roll, in accordance with the width of the paper, to position a first end of the soft roll to protrude beyond a first edge of the paper within a predefined edge width and to position a first end of the hard roll to protrude beyond a second edge of the paper within a predefined edge width.

2. The process according to claim 1, further comprising:

fixing a position of one of the first edge and the second edge independent of the sheet width; and axially adjusting only one of the hard roll and soft roll.

3. The process according to claim 2, further comprising:

scanning an other of the one edge to determine the sheet width; and axially adjusting the one roll in accordance with the determined sheet width.

4. The process according to claim 1, further comprising:

supplying the paper symmetrically with respect to a center of the calender; and axially adjusting each roll in opposite directions.

5. The process according to claim 4, further comprising:

scanning at least one of the first and second edges;

determine the sheet width; and axially adjusting each roll in accordance with the determined sheet width.

6. The process according to claim 1, wherein the soft roll comprises a zone-controlled deflection adjustment roll having a plurality of pressure zones in which the pressure zones located beyond the region covered by the width of the sheet are reduced with respect to the pressure zones within the region covered by the width of the sheet.

7. A calender for satining paper, comprising:

a heated hard roll;

a soft roll having a covering;

at least one roll gap formed between the hard roll and the soft roll;

a device for axially adjusting the rolls relative to each other;

a first end of the hard roll positioned with respect to a first edge of the paper; and a first end of the soft roll positioned with respect to a second edge of the paper.

8. The calender according to claim 7, further comprising:

a sheet guidance device that holds one of the first and second edges in a fixed position;

a detection device that detects a position of an other of the one edges; and the axially adjusting device adjusting only one of the rolls with respect to an output of the detection device.

9. The calender according to claim 8, the only one roll adjusted is the hard roll.

10. The calender according to claim 9, further comprising:

an additional soft roll; and the hard roll, the soft roll and the additional soft roll forming two roll gaps.

11. The calender according to claim 7, further comprising:

a sheet guidance device that supplies the sheet centrally with respect to the calender;

a detection device that detects the position of at least one sheet edge, and a device for axially adjusting each roll with respect to the paper and in accordance with an output of the detection device.

12. The calender according to claim 7, further comprising:

a guide;

a carrier element;

an adjustment drive mechanism;

a bearing block being movable along the carrier element, via the guide, by the adjustment drive mechanism;

an actuation device for the drive mechanism coupled to the carrier element; and the axially adjustable roll being secured in the bearing block.

13. The calender according to claim 12, further comprising a calender column and a pivoting lever, the calender column coupled to the carrier element through the pivoting lever.

14. The calender according to claim 7, the covering comprising of a fiber reinforced plastic that has a high temperature stability.

15. The calender according to claim 7, further comprising a take-off device and a winding for supplying the paper; and the take-off device being axially adjustable with respect to the rolls.

16. The calender according to claim 7, the calender is part of a paper making machine.

17. A process for satining paper in a calender, the calender including a heated hard roll and a soft roll having an elastic covering, a roll gap formed between the hard roll and soft roll, and the hard roll and the soft roll each including a cylinder having a substantially similar width, the process comprising:

guiding paper to be satined through the roll gap, the paper having a width less than the substantially similar width of the hard and soft rolls;

axially adjusting the hard roll with respect to the soft roll such that a thickness of the paper separates a heated surface of the hard roll from a surface of the elastic covering of the soft roll.

18. The process according to claim 17, the axial adjustment comprising:

positioning a first end of the hard roll proximately adjacent a first edge of the paper;

positioning a first end of the soft roll proximately adjacent a second edge of the paper;

forming a gap between the first end of the hard roll and the surface of the elastic covering of the soft roll located opposite the first end of the soft roll; and forming a gap between the first end of the soft roll and the heated surface of the hard roll located opposite the first end of the hard roll.

19. The process according to claim 18, the axial adjustment further comprising:

forming a gap between the first edge and the first end of the hard roll having a width less than or equal to a predetermined width; and forming a gap between the second edge and the first end of the soft roll having a width less than or equal to a predetermined width.

20. The process according to claim 17, further comprising:

arranging one of the first and second edges in a fixed position;

determining a width of the paper; and axially adjusting the hard roll in accordance with the detected width of the paper.

21. The process according to claim 20, further comprising:

detecting a location of an other of the one edges with a detection device;

determining a width of the paper in accordance with the detected location of the other edge;

forwarding the determined width to an adjustment drive mechanism; and driving a bearing block securing the hard roll to a position in accordance with the determined width.

22. The process according to claim 21, further comprising:

detecting a location of one of the edges of the paper with a detection device;

determining a width of the paper in accordance with the detected location of the one edge;

forwarding the determined width to an adjustment drive mechanism; and driving a bearing block securing the hard roll to a position in accordance with the determined width.

23. The process according to claim 17, further comprising:

supplying the paper substantially symmetrically with respect to a center of the calender;

determining a width of the paper; and axially adjusting each of the rolls in accordance with the detected width of the paper.

24. The process according to claim 23, further comprising:

detecting a location of each edge of the paper with a detection device;

determining a width of the paper in accordance with the detected location of the edges;

forwarding the determined width to an adjustment drive mechanism; and driving a bearing block securing the hard roll to a position in accordance with the determined width.

* * * * *